US008558748B2

(12) United States Patent
Chen et al.

(10) Patent No.: US 8,558,748 B2
(45) Date of Patent: Oct. 15, 2013

(54) PRINTED DUAL-BAND YAGI-UDA ANTENNA AND CIRCULAR POLARIZATION ANTENNA

(75) Inventors: Xin-Chang Chen, Taipei (TW); Min-Chung Wu, Taoyuan County (TW)

(73) Assignee: Ralink Technology Corp., Jhubei, Hsinchu County (TW)

( * ) Notice: Subject to any disclaimer, the term of this patent is extended or adjusted under 35 U.S.C. 154(b) by 468 days.

(21) Appl. No.: 12/895,765

(22) Filed: Sep. 30, 2010

(65) Prior Publication Data

US 2011/0090131 A1 Apr. 21, 2011

(30) Foreign Application Priority Data

Oct. 19, 2009 (TW) ..... 98135250 A
Oct. 22, 2009 (TW) ..... 98135749 A

(51) Int. Cl.
*H01Q 21/12* (2006.01)
*H01Q 9/16* (2006.01)
*H01Q 11/10* (2006.01)

(52) U.S. Cl.
USPC ..... 343/815; 343/792.5; 343/795; 343/822; 343/793; 343/818

(58) Field of Classification Search
None
See application file for complete search history.

(56) References Cited

U.S. PATENT DOCUMENTS 3,707,681 A * 12/1972 Grant ..... 455/275
5,712,643 A * 1/1998 Skladany ..... 343/700 MS
5,896,108 A * 4/1999 Shafai ..... 343/700 MS
5,898,410 A * 4/1999 DeMarre ..... 343/792.5
6,154,180 A * 11/2000 Padrick ..... 343/722
6,307,524 B1 * 10/2001 Britain ..... 343/795
6,326,922 B1 * 12/2001 Hegendoerfer ..... 343/700 MS
6,839,038 B2 * 1/2005 Weinstein ..... 343/795
7,205,953 B2 * 4/2007 Knadle et al. ..... 343/792.5
8,022,887 B1 * 9/2011 Zarnaghi ..... 343/846
2003/0160730 A1 * 8/2003 Alsliety ..... 343/818
2003/0231138 A1 * 12/2003 Weinstein ..... 343/795
2005/0057420 A1 * 3/2005 Lin et al. ..... 343/818
2012/0293387 A1 * 11/2012 Ohno ..... 343/818

FOREIGN PATENT DOCUMENTS

EP 1 376 757 A1 1/2004
JP 2009200719 A 9/2009

* cited by examiner

*Primary Examiner* — Trinh Dinh

(74) *Attorney, Agent, or Firm* — Winston Hsu; Scott Margo

(57) ABSTRACT

A printed dual-band Yagi-Uda antenna is disclosed, which includes a substrate, a first driver, a first director, a second driver and a reflector. The first driver is formed on the substrate, and is utilized for generating a radiation pattern of a first frequency band. The first director is formed at a side of the first driver on the substrate, and is utilized for directing the radiation pattern of the first frequency band toward a first direction. The second driver is formed between the first driver and the first director on the substrate, and is utilized for generating a radiation pattern of a second frequency band. The reflector is formed at another side of the first driver on the substrate, and is utilized for reflecting both the radiation patterns of the first frequency band and the second frequency band toward the first direction.

21 Claims, 18 Drawing Sheets

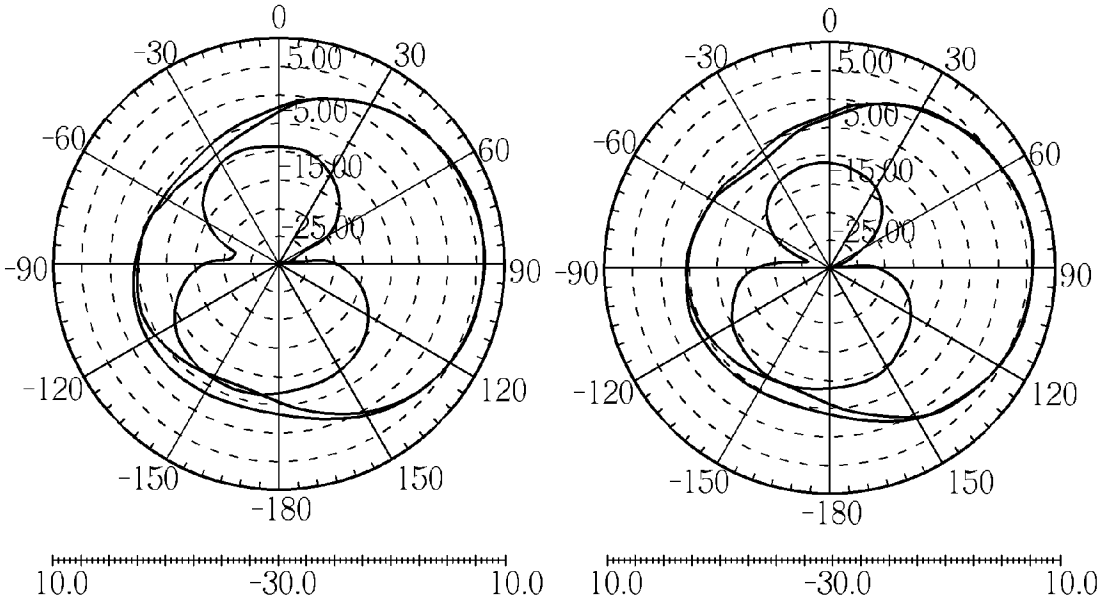
FIG. 10A
FIG. 10B
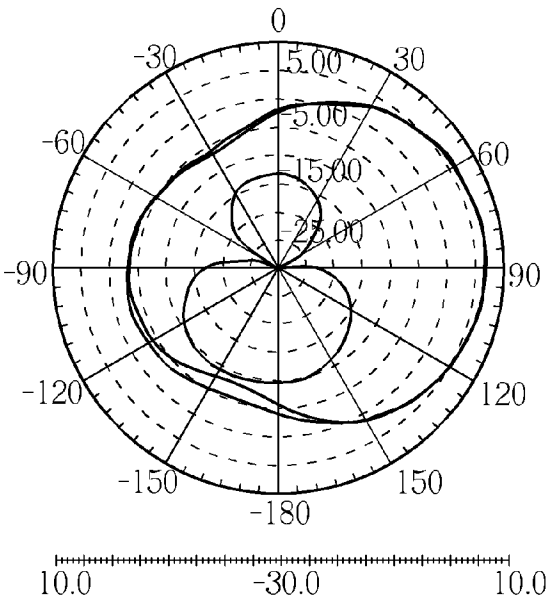
FIG. 10C 2.54GHz

5GHz 5.5GHz 5.8GHz

PRINTED DUAL-BAND YAGI-UDA ANTENNA AND CIRCULAR POLARIZATION ANTENNA

RELATED APPLICATIONS

This application claims priority under 35 U.S.C. 119 from TAIWAN 098135250 filed on Oct. 19, 2009 and TAIWAN 098135749 filed on Oct. 22, 2009, the contents of which are incorporated herein by references.

BACKGROUND OF THE INVENTION

1. Field of the Invention

The present invention relates to a printed dual-band Yagi-Uda antenna and a circular polarization antenna, and more particularly, to a printed dual-band Yagi-Uda antenna with a high directivity radiation pattern and a circular polarization antenna for a multi-input multi-output (MIMO) wireless communication system.

2. Description of the Prior Art

In modern life, various wireless communication networks have become essential for people to exchange voices, text messages, data, video files, etc. Since antennas are required for accessing these wireless communication networks with information carried by electromagnetic waves, development and research of the antennas have become one key issue for modern information technology manufacturers. In order to realize compact portable wireless communication devices, such as cell phones, personal digital assistants (PDAs), wireless USB dongles, the size of antennas should be implemented as small as possible, such that the antennas can be integrated into the portable communication devices.

Due to merits such as light weight, small size, and high compatibility with various circuits, a printed antenna is widely used for all kinds of wireless communication products. Generally speaking, in order to reduce blind angles of signal emission or reception, the printed antenna of the wireless communication product is mostly implemented by an omni-directional antenna, such as a dipole antenna. In a horizontal plane, signals of the omni-directional antenna radiate in 360 degree and have little variation in short distance, and thus the omni-directional antenna is suitable for practical applications. However, with introduction of an antenna array or a smart antenna technology, a single antenna is often required to have a high gain and high directivity radiation pattern. In such a condition, a printed Yagi-Uda antenna is proposed, which utilizes high directivity of the Yagi-Uda antenna to enhance antenna gain on an operating frequency band, such that communication quality can be improved.

Please refer to FIG. 1, which is a schematic diagram of a conventional Yagi-Uda antenna 10. The Yagi-Uda antenna 10 has a most basic structure of a Yagi-Uda antenna, and consists of three components: a driver 11, a reflector 12 and a director 13. The driver 11 is generally realized by a dipole antenna, and is utilized for producing resonance according to a fed time-varying current to generate a radiation field. The reflector 12 and the director 13 are formed by sheet metals or plate metals, and are utilized for exciting an in-phase and an anti-phase radiation electric field through electromagnetic coupling, respectively. As a result, the reflector 12 and the director 13 can reflect or direct the radiation patterns generated by the dipole antenna toward a specific direction, so as to enhance antenna gain. Of course, the number of parasitic elements such as the reflector and the director can be adjusted according to practical antenna gain requirements, which is known by those skilled in the art and therefore not detailed here.

In addition, a circular polarization antenna can be utilized for avoiding polarization dependent loss resulted from polarization mismatch between a transmission antenna and a reception antenna. Therefore, a receiver can be placed with more flexibility in practical applications. However, a normal circular polarization antenna is usually implemented in a single-band system structure, such as a satellite communication system, and does not have a high directive radiation pattern, so that requirement of current wireless communication product is hard to meet.

Besides, with advancement of wireless communication technologies, the number of antennas equipped for the electronic product is increased. For example, a multi-input multi-output (MIMO) communication technology is supported by IEEE 802.11n. That is, a related electronic product can simultaneously transmit and receive radio signals by use of multiple antennas, such that data throughput and transmission distance can be significantly increased without extra bandwidth or power expenditure. Thus, spectral efficiency and transmission rates of the wireless communication system can be enhanced, so as to improve communication quality.

However, the conventional printed Yagi-Uda antenna is a single band antenna, and can not meet multi-band requirements in current wireless communication products. In addition, each antenna of the conventional MIMO system has a fixed polarization direction and can not be adjusted according to system requirements, causing transmission efficiency is likely affected due to polarization mismatch. Thus, there is a need to improve.

SUMMARY OF THE INVENTION

It is therefore an objective of the present invention to provide a printed dual-band printed Yagi-Uda antenna.

The present invention discloses a printed dual-band Yagi-Uda antenna, which includes a substrate, a first driver, a first director, a second driver, a reflector and a transmission line. The first driver is formed on the substrate, and is utilized for generating a radiation pattern of a first frequency band. The first director is formed at a side of the first driver on the substrate in a first direction, and is utilized for directing the radiation pattern of the first frequency band toward the first direction. The second driver is formed between the first driver and the first director on the substrate, and is utilized for generating a radiation pattern of a second frequency band. A distance between the second driver and the first director makes the first director an open-circuit element of the second frequency band. The reflector is formed at another side of the first driver on the substrate in an opposite direction of the first direction, and is utilized for reflecting both the radiation patterns of the first frequency band and the second frequency band toward the first direction. The transmission line is formed along the first direction on the substrate, and is sequentially coupled to the reflector, the first driver and the second driver.

The present invention discloses a circular polarization antenna for a multi-input multi-output wireless communication system. The circular polarization antenna includes a first substrate, a second substrate, a first linear polarization antenna and a second linear polarization antenna. The second substrate is perpendicular to or formed vertically on the first substrate. The first linear polarization antenna is formed on the first substrate, and is utilized for generating a radiation field of a first polarization direction according to a first feeding signal. The second linear polarization antenna is formed on the second substrate, and has a same structure with the first linear polarization antenna, and is utilized for generating a radiation field of a second polarization direction according to a second feeding signal. The first polarization direction is orthogonal to the second polarization direction, and the first feeding signal and the second feeding signal area same feeding signal with a specific phase difference.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 10A to FIG. 10C are antenna gain diagrams of the low frequency band of the printed dual-band Yagi-Uda antenna shown in FIG. 2.

DETAILED DESCRIPTION

Figure 1:
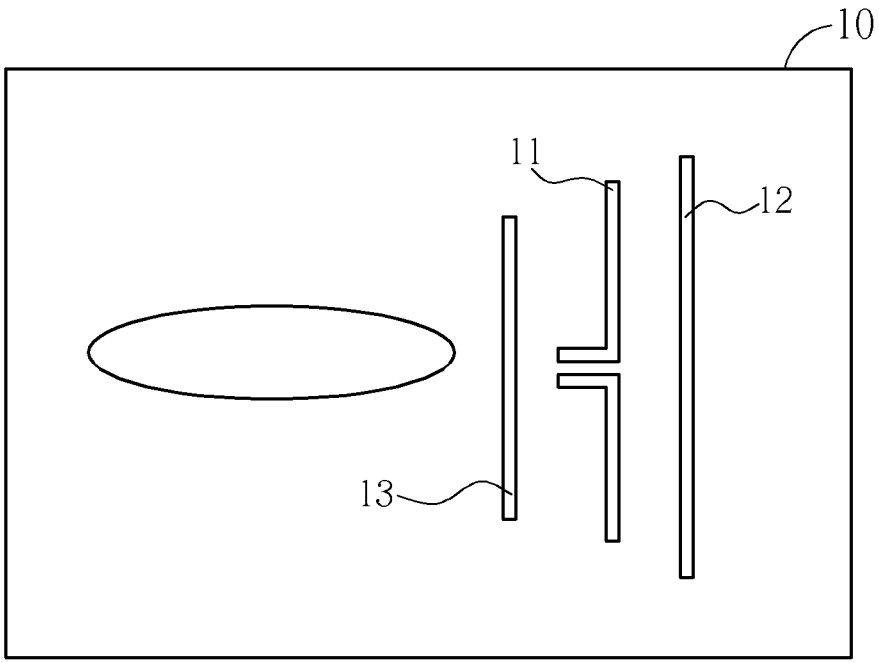
FIG. 1 PRIOR ART
FIG. 1 is a schematic diagram of a conventional Yagi-Uda antenna.
Figure 2:
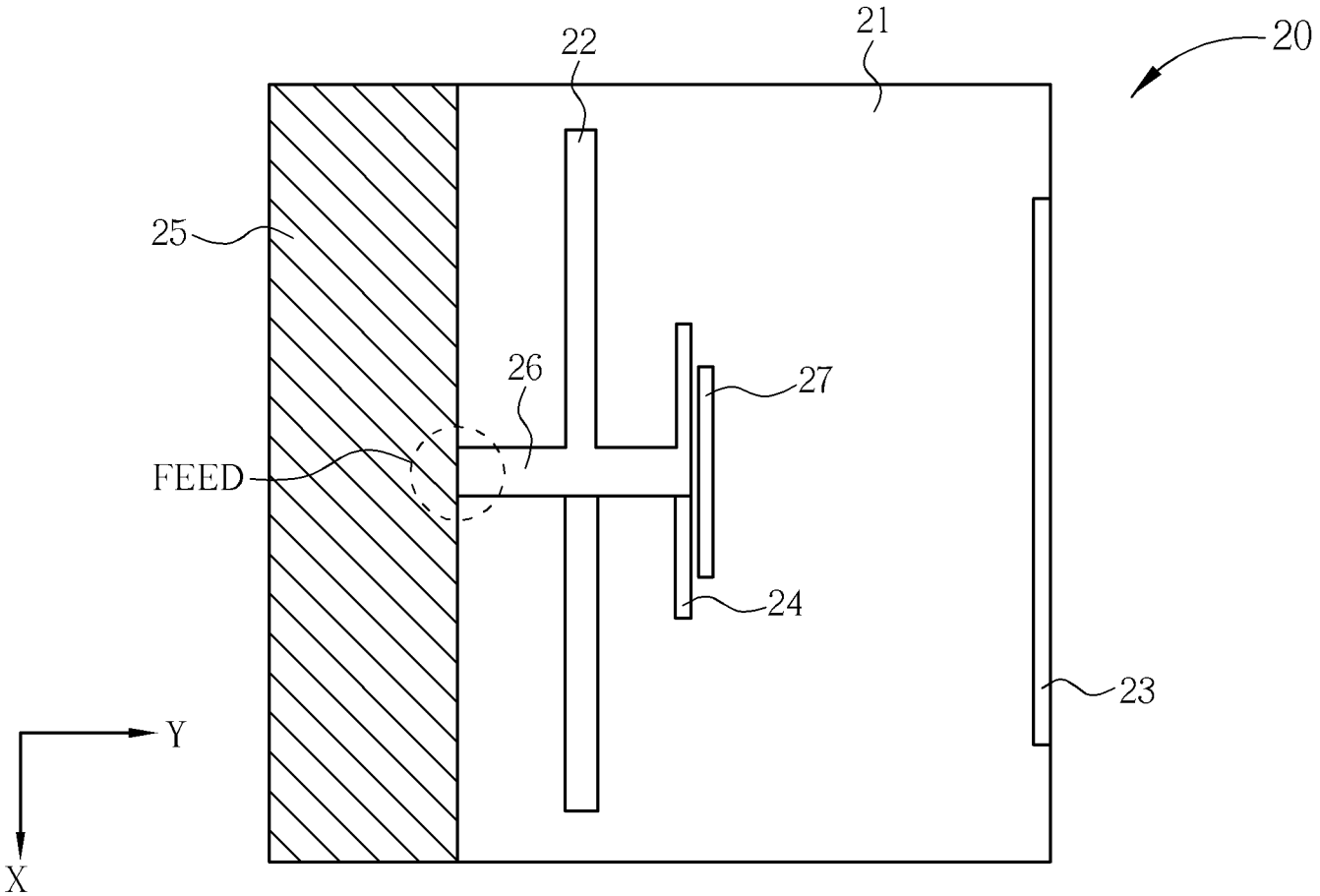
FIG. 2 is a schematic diagram of a printed dual-band Yagi-Uda antenna according to an embodiment of the present invention.

Please refer to FIG. 2, which is a schematic diagram of a printed dual-band Yagi-Uda antenna 20 according to an embodiment of the present invention. The printed dual-band Yagi-Uda antenna 20 includes a substrate 21, a low frequency driver 22, a low frequency director 23, a high frequency driver 24, a reflector 25 and a transmission line 26. The low frequency driver 22 is formed on the substrate 21, and is utilized for generating a radiation pattern of a low frequency band. The low frequency director 23 is formed at a side of the low frequency driver 22 on the substrate 21, and is utilized for directing the radiation pattern of the low frequency band toward +Y-axis direction. The high frequency driver 24 is formed between the low frequency driver 22 and the low frequency director 23 on the substrate 21, and is utilized for generating a radiation pattern of a high frequency band. For high frequency signals generated by the high frequency driver 24, a distance between the high frequency driver 24 and the low frequency director 23 makes the low frequency director 23 an open-circuit element. The reflector 25 is formed at another side of the low frequency driver 22 on the substrate 21, and is utilized for reflecting both the radiation patterns of the low frequency band and the high frequency band toward the +Y-axis direction. The transmission line 26 is formed along the Y-axis direction on the substrate 21, and is sequentially coupled to the reflector 25, the low frequency driver 22 and the high frequency driver 24. The transmission line 26 is utilized for transmitting a feeding signal to the low frequency driver 22 and the high frequency driver 24. In addition, the printed dual-band Yagi-Uda antenna 20 further includes a high frequency matching element 27. The high frequency matching element 27 is formed adjacent to the high frequency driver 24 on the substrate 21, and acts as a reactive load of the high frequency driver 24 to increase a bandwidth of the high frequency band.

Figure 3:
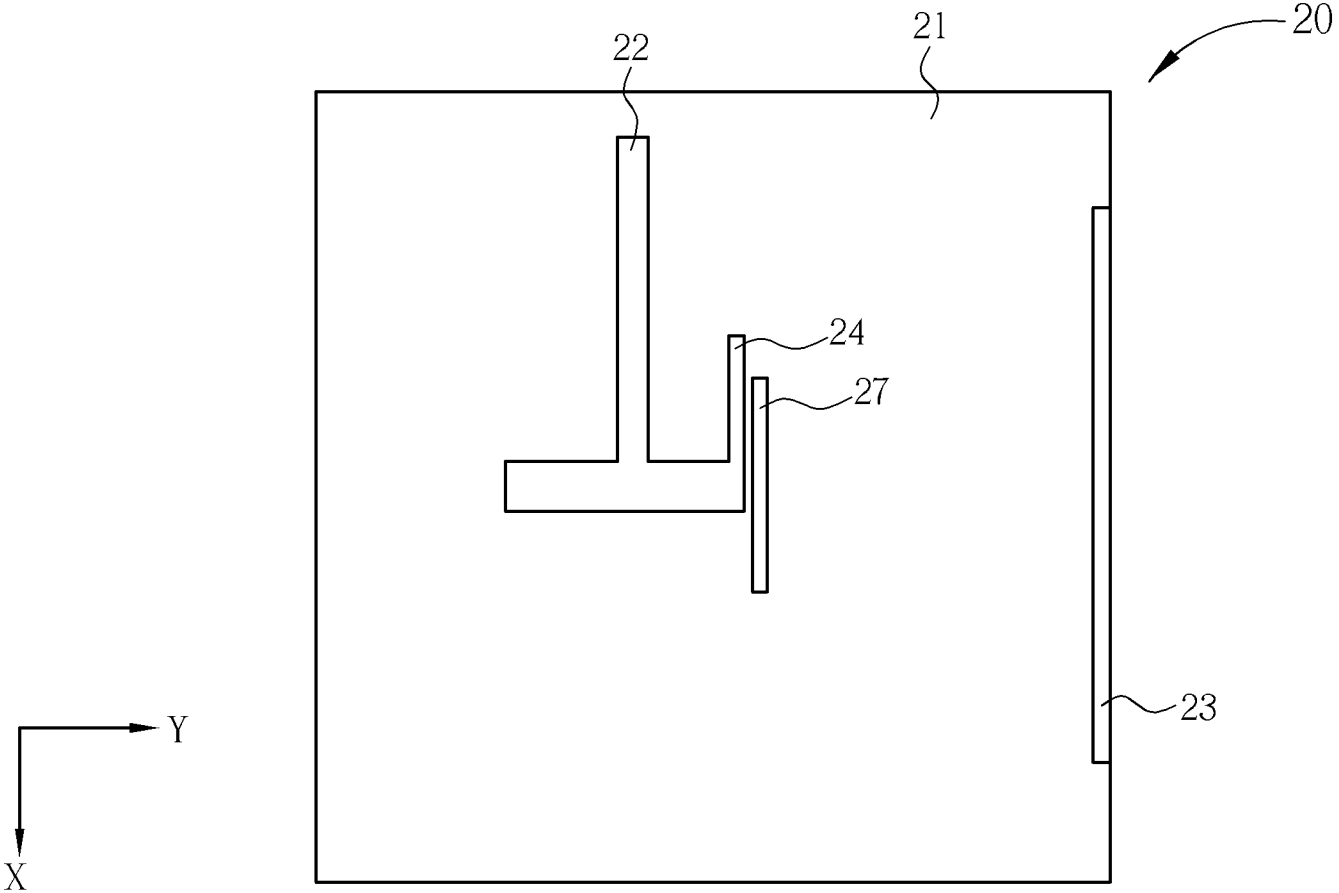
FIG. 3 is a three-dimensional diagram of the printed dual-band Yagi-Uda antenna shown in FIG. 2.
Figure 4:
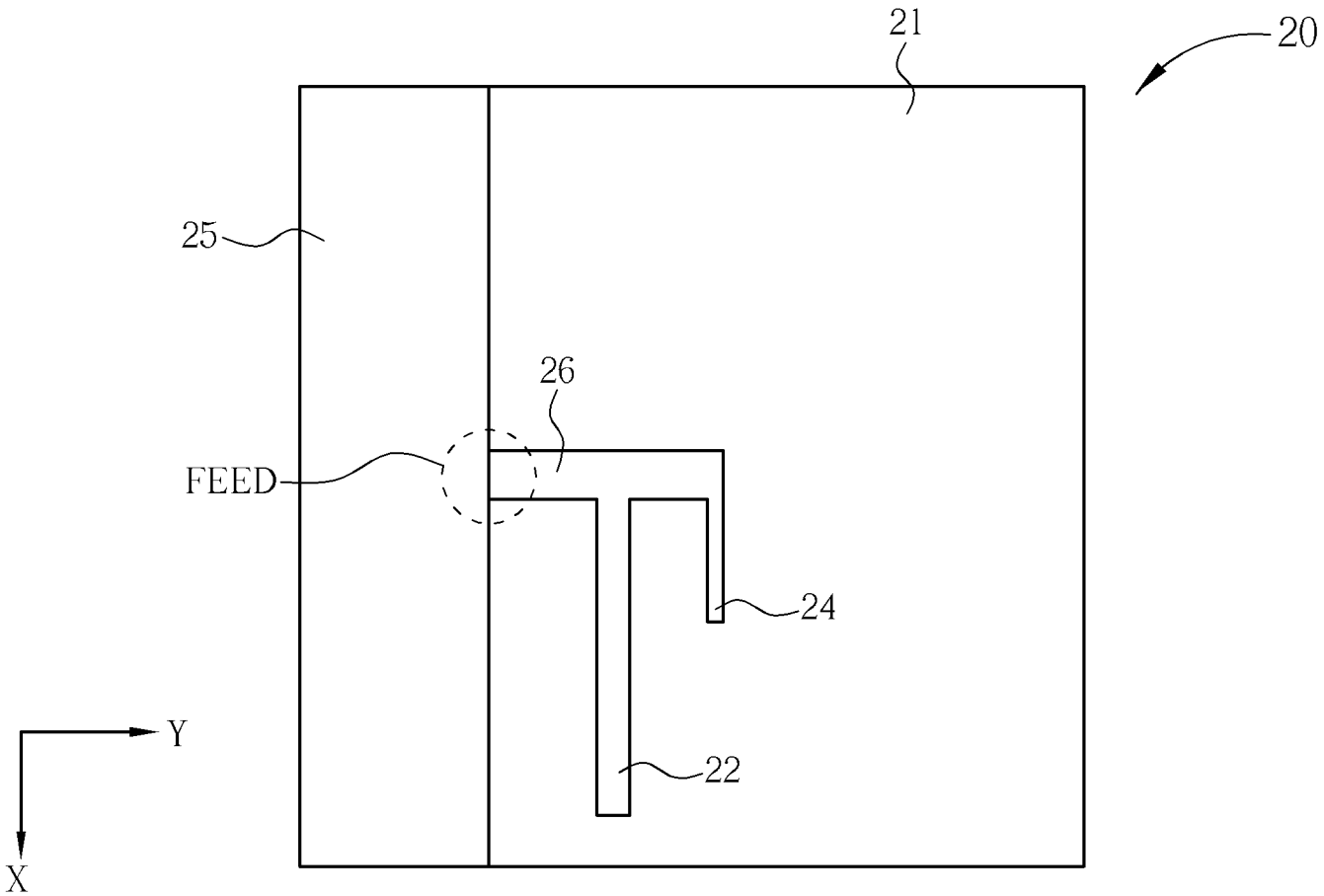
FIG. 4 is a layout diagram of an upper metal layer of the printed dual-band Yagi-Uda antenna shown in FIG. 2.
Figure 5:
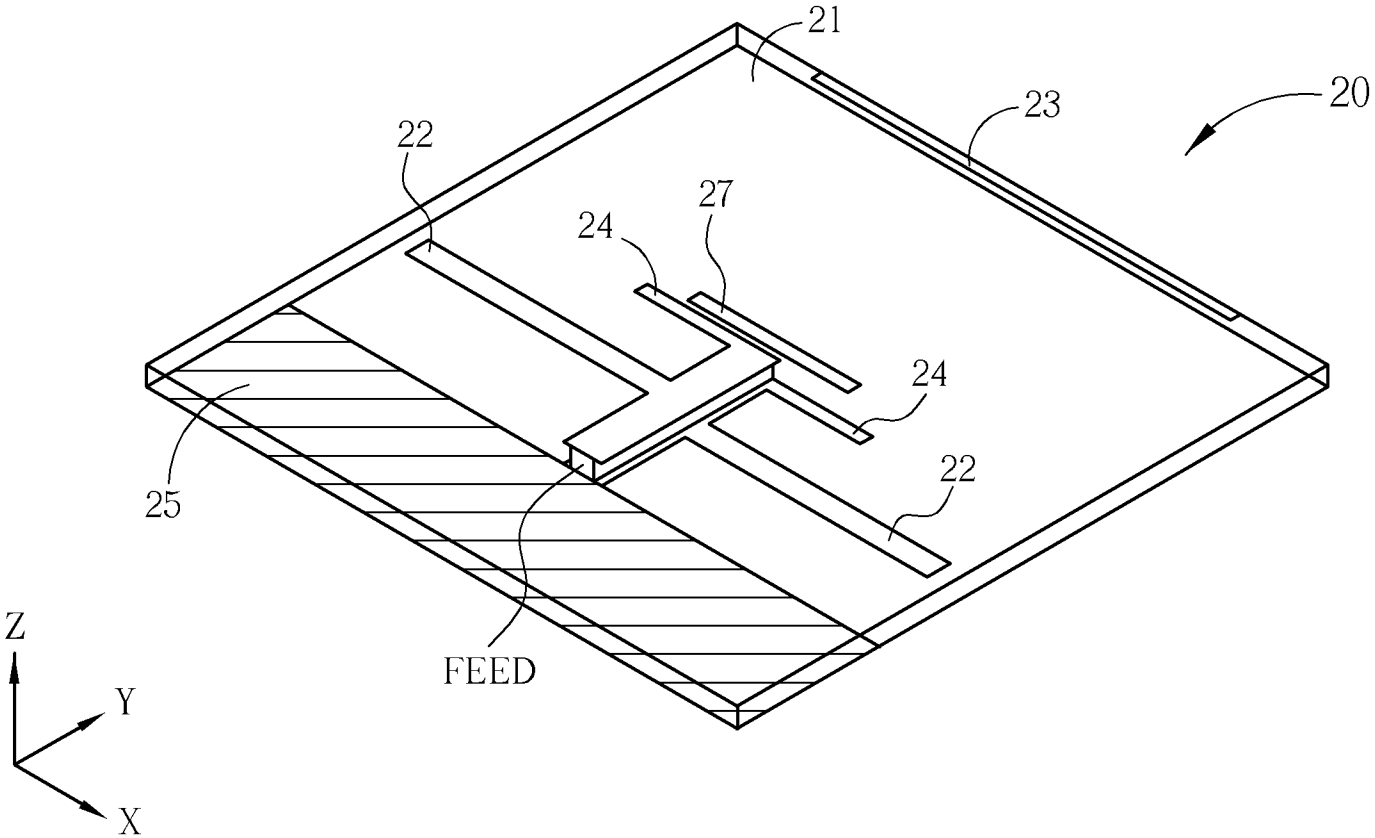
FIG. 5 is a layout diagram of a lower metal layer of the printed dual-band Yagi-Uda antenna shown in FIG. 2.

In the embodiment of the present invention, the substrate 21 can be realized by an FR4 double-layer fiberglass board, and includes an upper metal layer and a lower metal layer. The low frequency driver 22 and the high frequency driver 24 are realized by a dipole antenna parallel with X-axis direction, respectively. Each dipole antenna includes two radiation elements, which are formed in the upper metal layer and the lower metal layer, respectively. The reflector 25 is realized by a sheet metal. The reflector 25 is formed in the lower metal layer of the substrate 21, and is coupled to a system ground, while the low frequency director 23 and the high frequency matching element 27 are formed in the upper metal layer of the substrate 21. The transmission line 26 is realized by a micro-strip line, and an end coupled to the reflector 25 forms a feeding terminal FEED of the printed dual-band Yagi-Uda antenna 20. As for detailed structure of the printed dual-band Yagi-Uda antenna 20, please refer to FIG. 3 to FIG. 5. FIG. 3 is a three-dimensional diagram of the printed dual-band Yagi-Uda antenna 20. FIG. 4 is a layout diagram of the upper metal layer of the printed dual-band Yagi-Uda antenna 20. FIG. 5 is a layout diagram of the lower metal layer of the printed dual-band Yagi-Uda antenna 20.

For details of each part of the printed dual-band Yagi-Uda, please refer to the following descriptions. In the embodiment of the present invention, the low frequency driver 22 and the high frequency driver 24 are realized by the dipole antennas parallel with the X-direction, respectively, and are utilized for generating the radiation patterns of the low frequency band and the high frequency band. If the reflector 25 and the low frequency director 23 are not considered, the radiation patterns generated by the dipole antennas are omni-directional. Generally, length of each radiation element of the dipole antenna is substantially a quarter wavelength of a radiation frequency, and a distance between the low frequency driver 22 and the reflector 25 is substantially 0.1 to 0.25 times a wavelength of the low frequency band.

Figure 6:
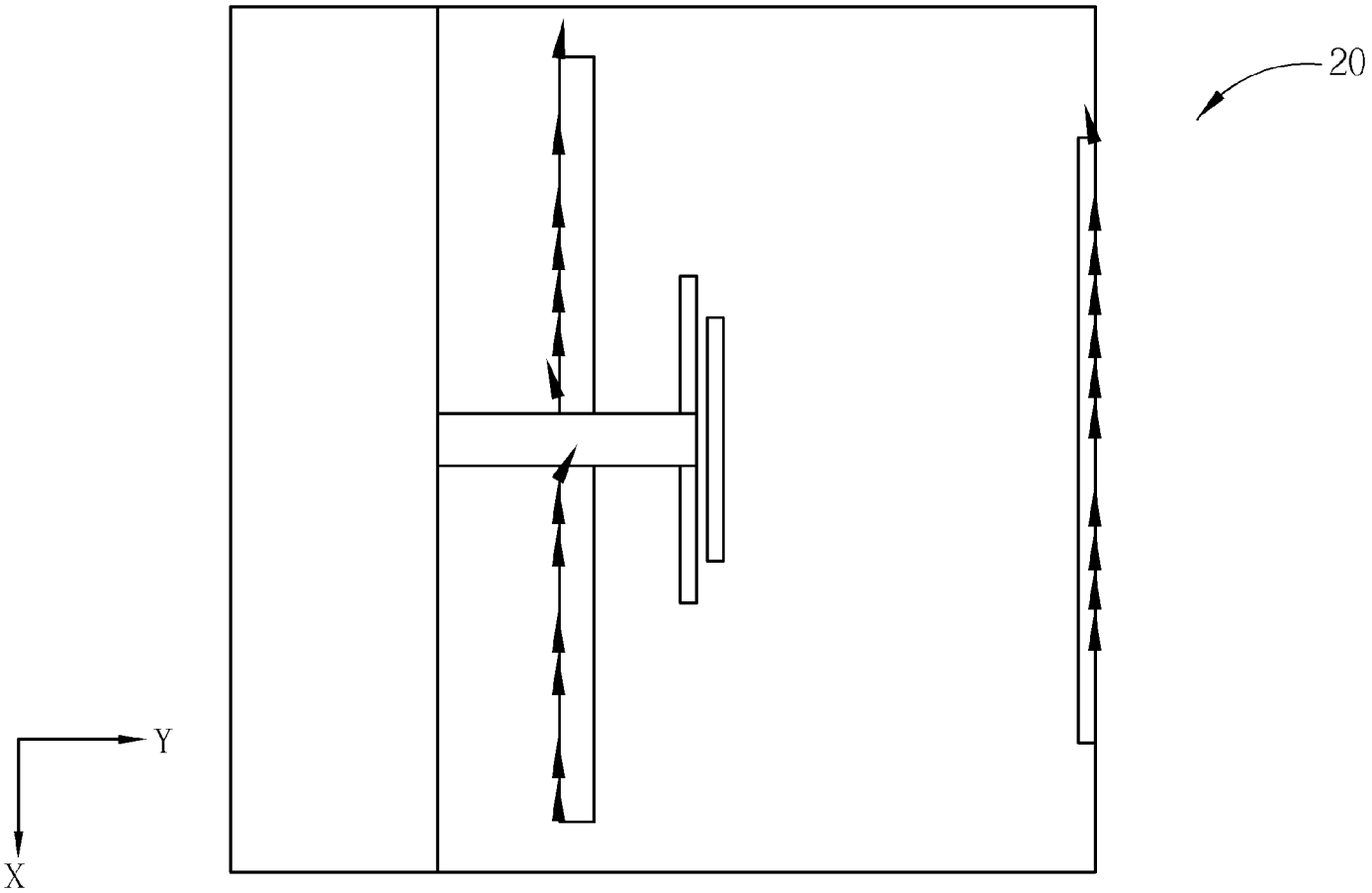
FIG. 6 illustrates current distribution of a low frequency director in FIG. 2 excited by a time-varying current of a low frequency driver.

The low frequency director 23 is mainly utilized for directing the radiation pattern generated by the low frequency driver 22 toward the +Y-axis direction, such that the radiation pattern of the low frequency band has higher directivity. Generally, a distance between the low frequency driver 23 and the low frequency director 22 is substantially 0.1 to 0.25 times a wavelength of the low frequency band. Please refer to FIG. 6, which illustrates current distribution of the low frequency director 23 excited by a time-varying current of the low frequency driver 22. As shown in FIG. 6, the time-varying current of the low frequency driver 22 and the excited current of the low frequency director 23 are in a same direction. Thus, the low frequency director 23 is a good director for the low frequency driver 22, and can direct the radiation pattern of the low frequency band toward the +Y-axis direction. In addition, the distance between the low frequency director 23 and the high frequency driver 24 can be properly adjusted, such that the low frequency director 23 acts as an open-circuit element for the high frequency signals generated by the high frequency driver 24. Consequently, the radiation pattern generated by the high frequency driver 24 would not be affected by the low frequency director 23.

Please note that the high frequency driver 24 does not function as a director of the low frequency driver 22 because the distance between the high frequency driver 24 and the low frequency driver 24 is too short. Normally, a director needs a distance substantially 0.1 to 0.25 times a wavelength of an operating frequency from a driver to function well.

Figure 7:
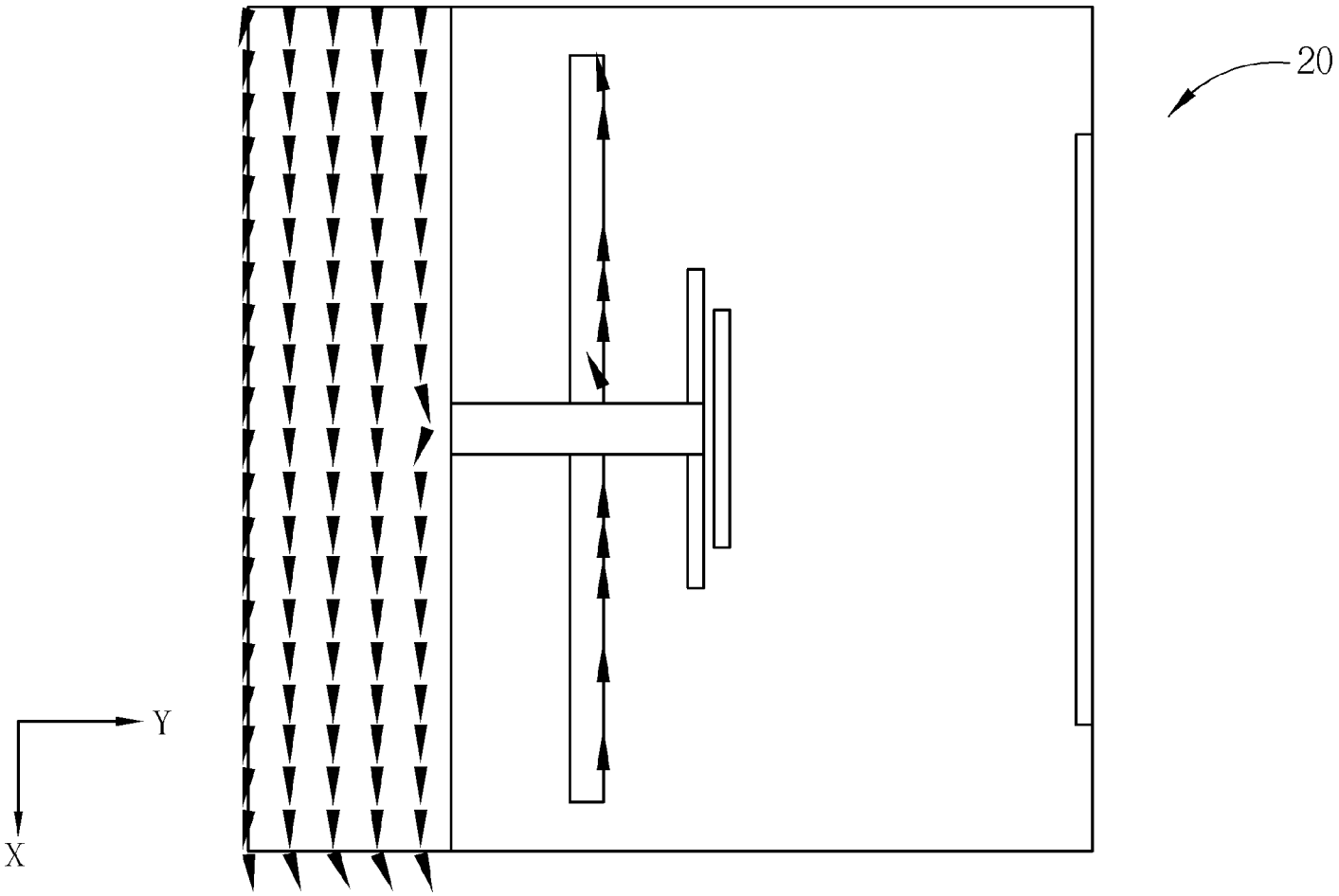
FIG. 7 illustrates current distribution of a reflector in FIG. 2 excited by a time-varying current of a low frequency driver.
Figure 8:
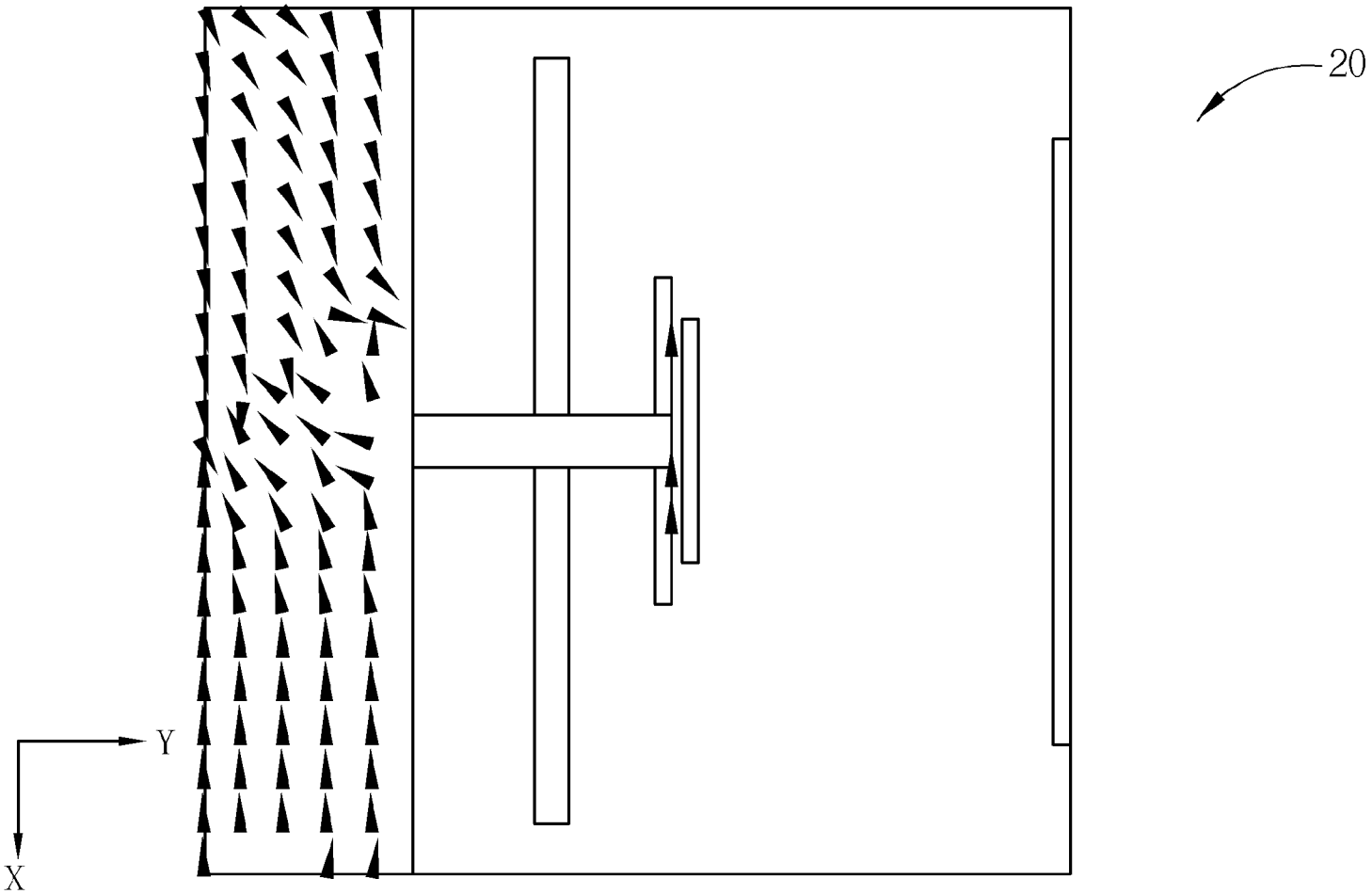
FIG. 8 illustrates current distribution of a reflector in FIG. 2 excited by s time-varying current of a high frequency driver.

The reflector 25 mainly has the following two functions: (1) acting as a ground of the antenna and (2) reflecting both the radiation patterns generated by the low frequency driver 22 and the high frequency driver 24 to make the radiation patterns have high directivity. Please refer to FIG. 7 and FIG. 8, which illustrate current distribution of the reflector 25 excited by time-varying currents of the low frequency driver 22 and the high frequency driver 24, respectively. As shown in FIG. 7, for the low frequency band, ground current of the antenna completely flows in a direction opposite to the time-varying current of the low frequency driver 22. As shown in FIG. 8, for the high frequency band, the ground current also flows in the direction opposite to the time-varying current of the high frequency driver 24. Namely, in the embodiment of the present invention, the reflector 25 can be simultaneously used as a reflection board for the high frequency driver and the low frequency driver, such that the radiation patterns of the low frequency band and the high frequency band can radiate toward the +Y-axis direction.

The high frequency matching element 27 is utilized for providing capacitive impedance to perform impedance matching with inductive load of the transmission line 26. Therefore a reflection coefficient bandwidth of the high frequency band can be increased without affecting that of the low frequency band. For the high frequency signals generated by the high frequency driver 24, the high frequency matching element 27 does not function as a director either because a distance between the high frequency matching element 27 and the high frequency driver 24 is too short, and normally, the director needs a distance substantially 0.1 to 0.25 times a wavelength from the driver to have apparent functionality. Therefore, the high frequency matching element 27 is merely an impedance matching element for enhancing the bandwidth of the high frequency band.

In brief, the ground of the antenna is used as the reflector both for the low frequency driver 22 and the high frequency driver 24, and locations of the low frequency director 23 and the high frequency driver 24 are designed such that the radiation pattern of the low frequency band can be pushed forward by the low frequency director 23 while the radiation pattern of the high frequency band is not affected. As a result, the dual-band Yagi-Uda antenna can have high directivity in one single plane without adding extra mechanisms or devices to change the radiation pattern.

Of course, the aforementioned printed dual-band Yagi-Uda antenna structure can be implemented in any dual-band system, such as an IEEE 802.11 dual-band wireless local area network (WLAN) system. In the embodiment of the present invention, signals of the printed dual-band Yagi-Uda antenna 20 are fed into the feeding terminal FEED by a single feed method. Other embodiments may adopt a differential feed method as used in conventional Yagi-Uda antennas, while a Balun is needed on the structure. This variation is known by those skilled in the art, and is not narrated herein.

Figure 9:
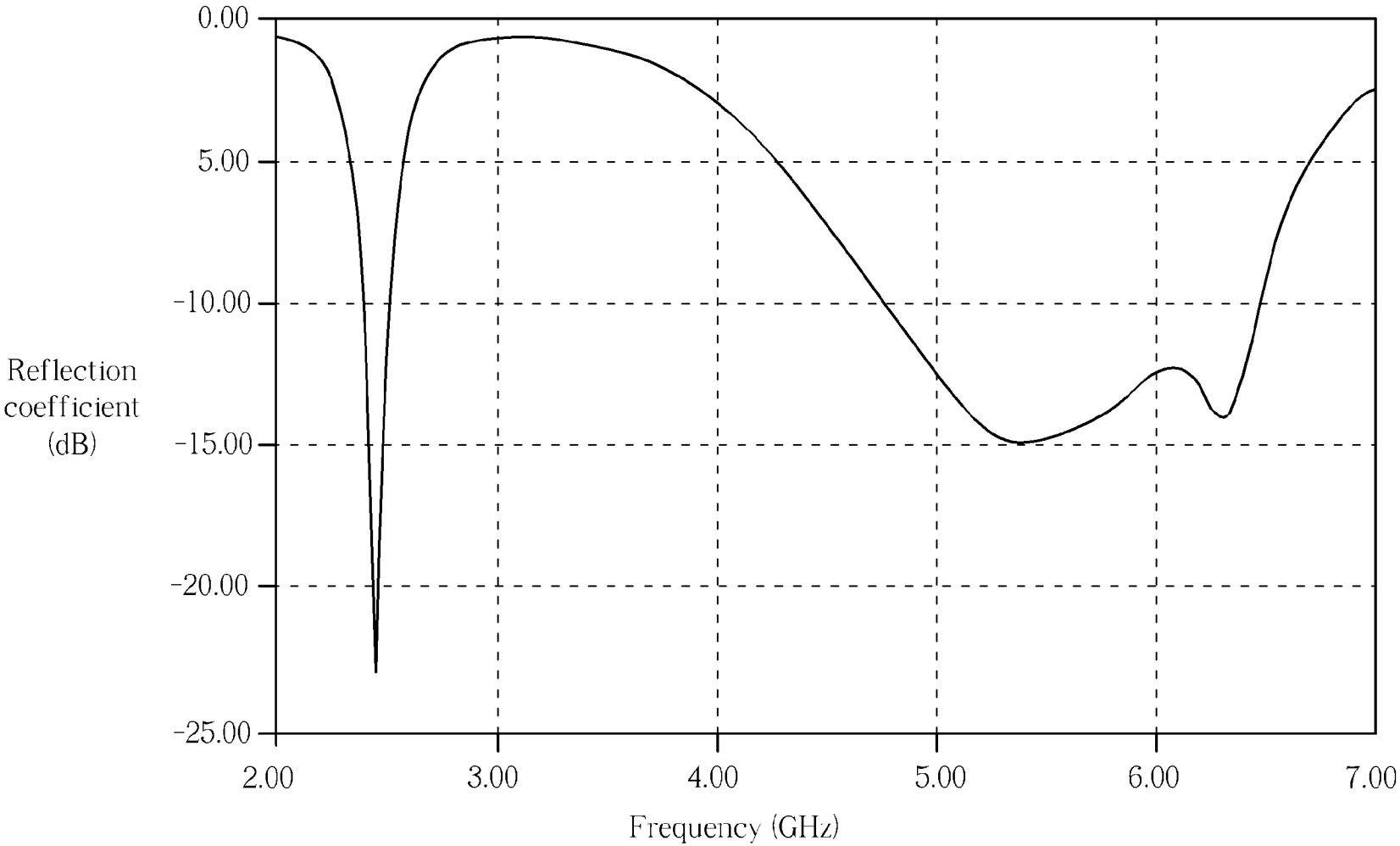
FIG. 9 is a reflection coefficient diagram of the printed dual-band Yagi-Uda antenna shown in FIG. 2.
Figures 11A, 11B, 11C:
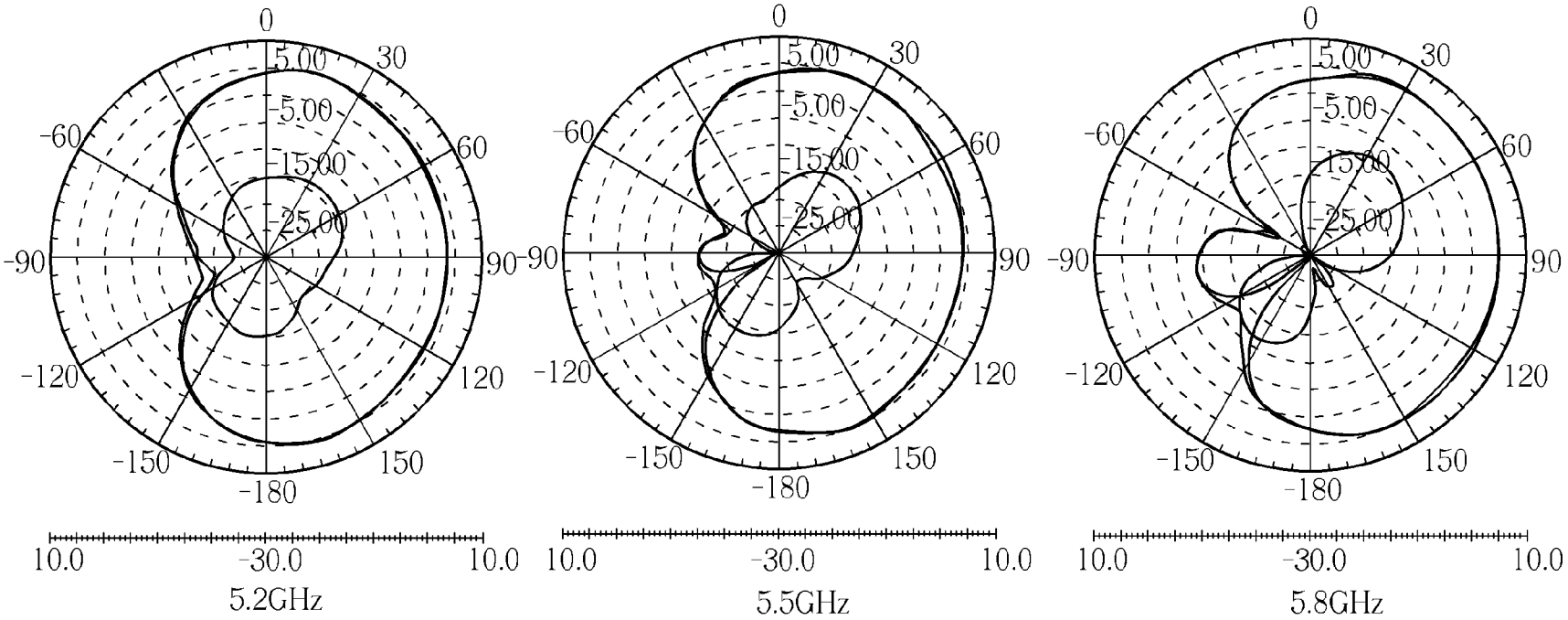
FIG. 11A to FIG. 11C are antenna gain diagrams of the high frequency band of the printed dual-band Yagi-Uda antenna shown in FIG. 2.

In the embodiment of the present invention, a size of the printed dual-band Yagi-Uda antenna 20 is substantially 50 mm×50 mm×1.6 mm, and the low frequency driver and the high frequency driver are utilized for generating operating frequencies of IEEE 802.11b/g and IEEE 802.11a, respectively. In this case, simulation results of the printed dual-band Yagi-Uda antenna 20 are shown in FIG. 9 to FIG. 11. FIG. 9 is a reflection coefficient diagram of the printed dual-band Yagi-Uda antenna 20, FIG. 10A to FIG. 10C are antenna gain diagrams of the low frequency band of the printed dual-band Yagi-Uda antenna 20, and FIG. 11A to FIG. 11C are antenna gain diagrams of the high frequency band of the printed dual-band Yagi-Uda antenna 20. As shown in FIG. 9, if a criterion is set at −10 dB, the low frequency band of the printed dual-band Yagi-Uda antenna 20 is substantially between 2.39 GHZ~2.51 GHz, while the high frequency band is substantially between 4.79 GHz~6.46G Hz. Accordingly, the high frequency band of the printed dual-band Yagi-Uda antenna 20 is effectively increased by the high frequency matching element 27.

As shown in FIG. 10 and FIG. 11, both the radiation patterns of the high frequency band and low frequency band have excellent directivity. However, since the printed dual-band Yagi-Uda antenna 20 has an extra director for the low frequency band rather than the high frequency band, the antenna gain of the low frequency band is better than that of the high frequency band. Besides, although the low frequency director 23 is longer than the high frequency driver 24, as long as the location of the low frequency director 23 is properly selected, the low frequency director 23 would act as an open-circuit element for the high frequency signals generated by the high frequency driver 24.

Figure 12:
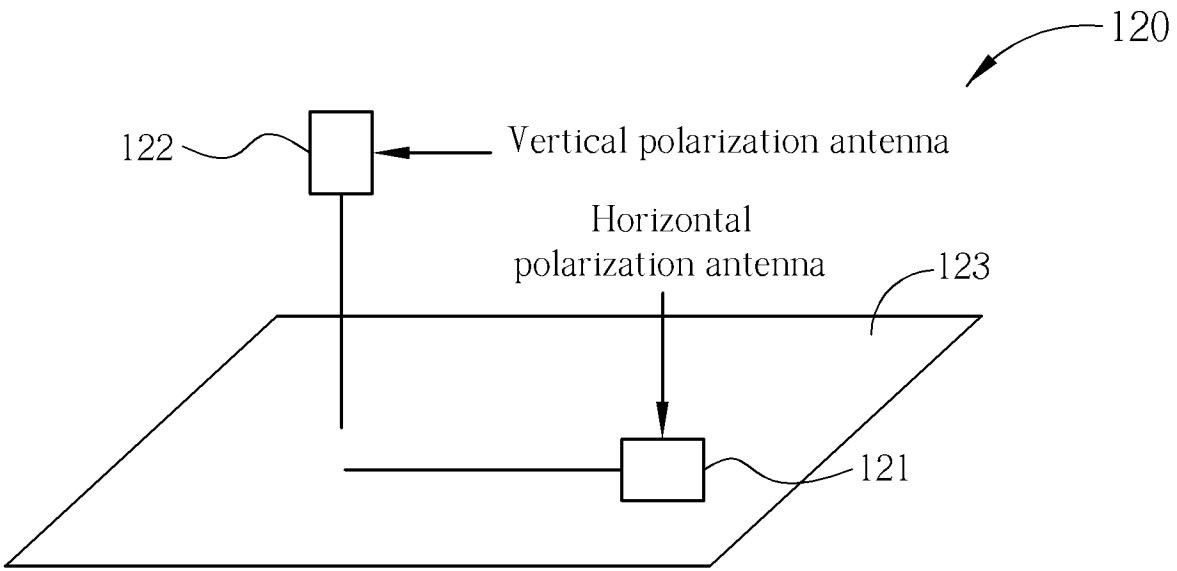
FIG. 12 illustrates a design concept of a circular polarization antenna according to the present invention.

In addition, please refer to FIG. 12, which illustrates a design concept of a circular polarization antenna 120 according to the present invention. The circular polarization antenna 120 is realized in a multi-input multi-output (MIMO) wireless communication system, such as a wireless communication system conforming to IEEE 802.11n standard, for performing radio signal transmission and reception simultaneously. As shown in FIG. 12, the circular polarization antenna 120 includes a horizontal polarization antenna 121 and a vertical polarization antenna 122. The horizontal polarization antenna 121 and the vertical polarization antenna 122 can be realized by two identical linear polarization antennas, and are arranged on a horizontal substrate 123 and a vertical substrate (not shown) which are orthogonally assembled with each other, respectively. The horizontal polarization antenna 121 and the vertical polarization antenna 122 are utilized for providing a horizontal polarization radiation field and a vertical polarization radiation field with same energy. In this case, feeding signals having a specific phase difference to the horizontal polarization antenna 121 and the vertical polarization antenna 122, respectively, can produce a circular polarization radiation field.

In more detail, the circular polarization antenna 120 can provide two kinds of circular polarization radiation field according to the signal feeding manner, in order to meet requirements of the wireless communication system. For example, assume both the feeding signals of the horizontal polarization antenna 121 and the vertical polarization antenna 122 have same amplitudes. If the feeding signal of the horizontal polarization antenna 121 has a 90 degree phase lead over that of the vertical polarization antenna 12, a left-hand circular polarization radiation field is generated; otherwise, if the feeding signal of the horizontal polarization antenna 121 has a 90 degree phase lag over that of the vertical polarization antenna 122, then a right-hand circular polarization radiation field is generated.

Of course, the signal feeding manner of the circular polarization antenna 120 can further be adjusted according to practical demands, for generating radiation fields of all kinds of polarization direction, such as horizontal polarization, vertical polarization, and elliptical polarization. Such variation is also included in the scope of the present invention. For example, if the signals are only fed into the horizontal polarization antenna 121 but not fed into the vertical polarization antenna 122, the circular polarization antenna 120 would generate a horizontal polarization radiation field; similarly, if the signals are only fed into the vertical polarization antenna 12 but not fed into the horizontal polarization antenna 121, the circular polarization antenna 120 would generate a vertical polarization radiation field. In addition, if phases and amplitude of the feeding signals of the horizontal polarization antenna 121 and the vertical polarization antenna 122 are properly adjusted, then each kind of linear polarization fields or elliptical polarization fields can be generated.

Please note that the said horizontal polarization antenna 121 and the vertical polarization antenna 122 can be realized by any type of linear polarization antennas. However, for meeting high gain and multi-band requirements for a single antenna in the MIMO system, the present invention realizes a circular polarization antenna by a printed dual-band directional antenna such as a printed dual-band Yagi-Uda antenna in the following embodiment, for enhancing polarization matching and transmission efficiency.

Figure 13:
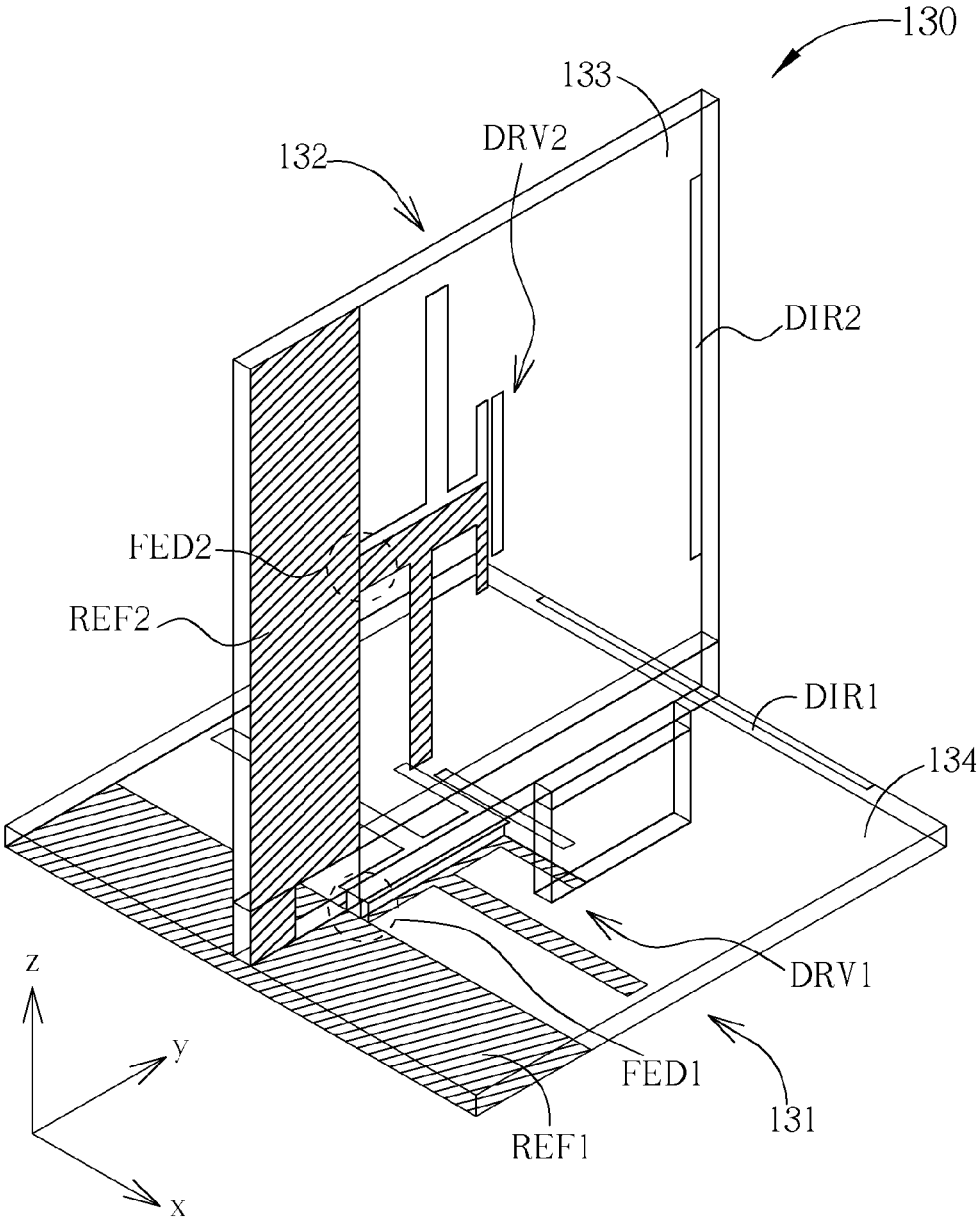
FIG. 13 is a schematic diagram of a circular polarization antenna according to an embodiment of the present invention.
Figure 14:
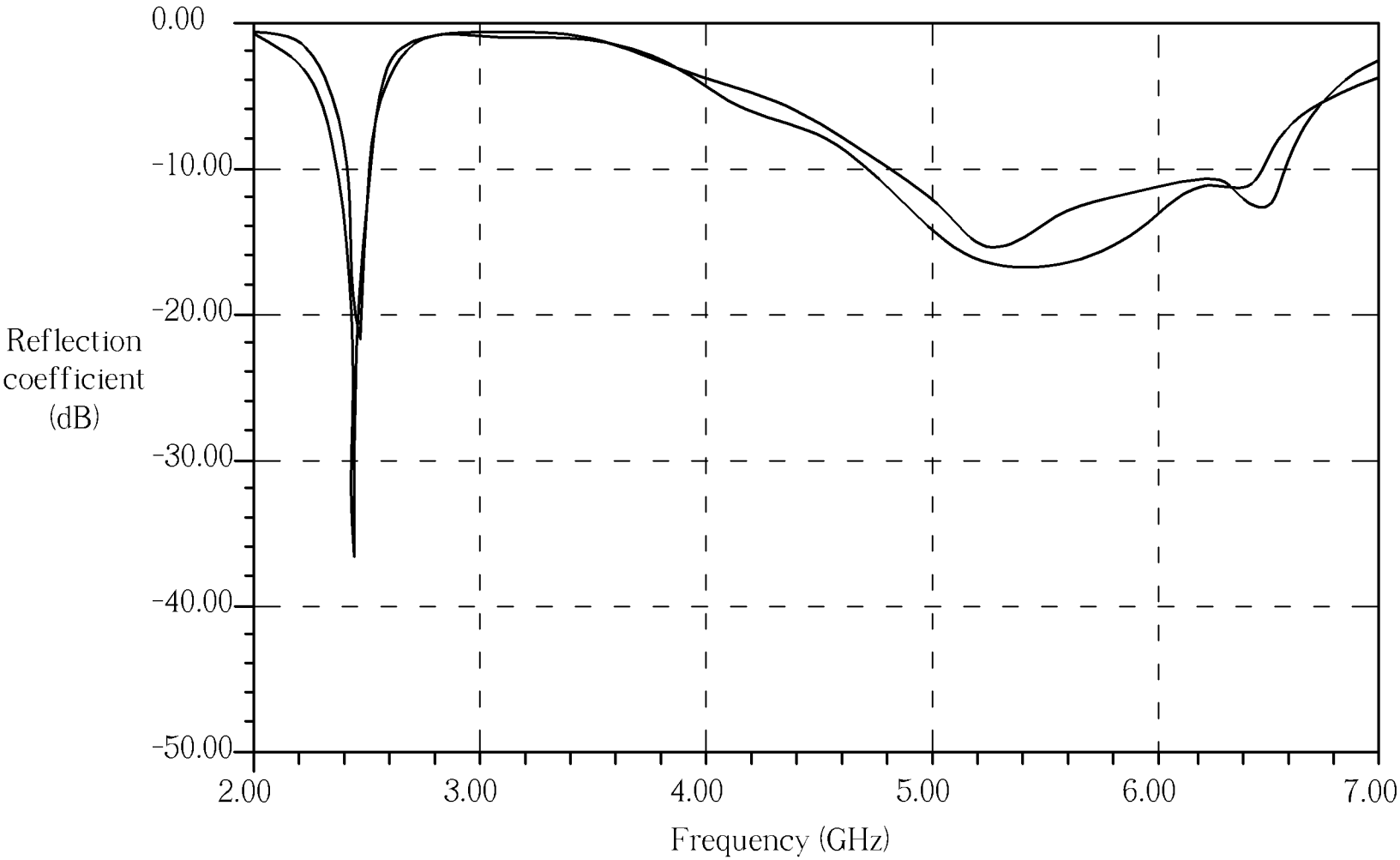
FIG. 14 is a reflection coefficient diagram of the circular polarization antenna shown in FIG. 13.
Figure 15:
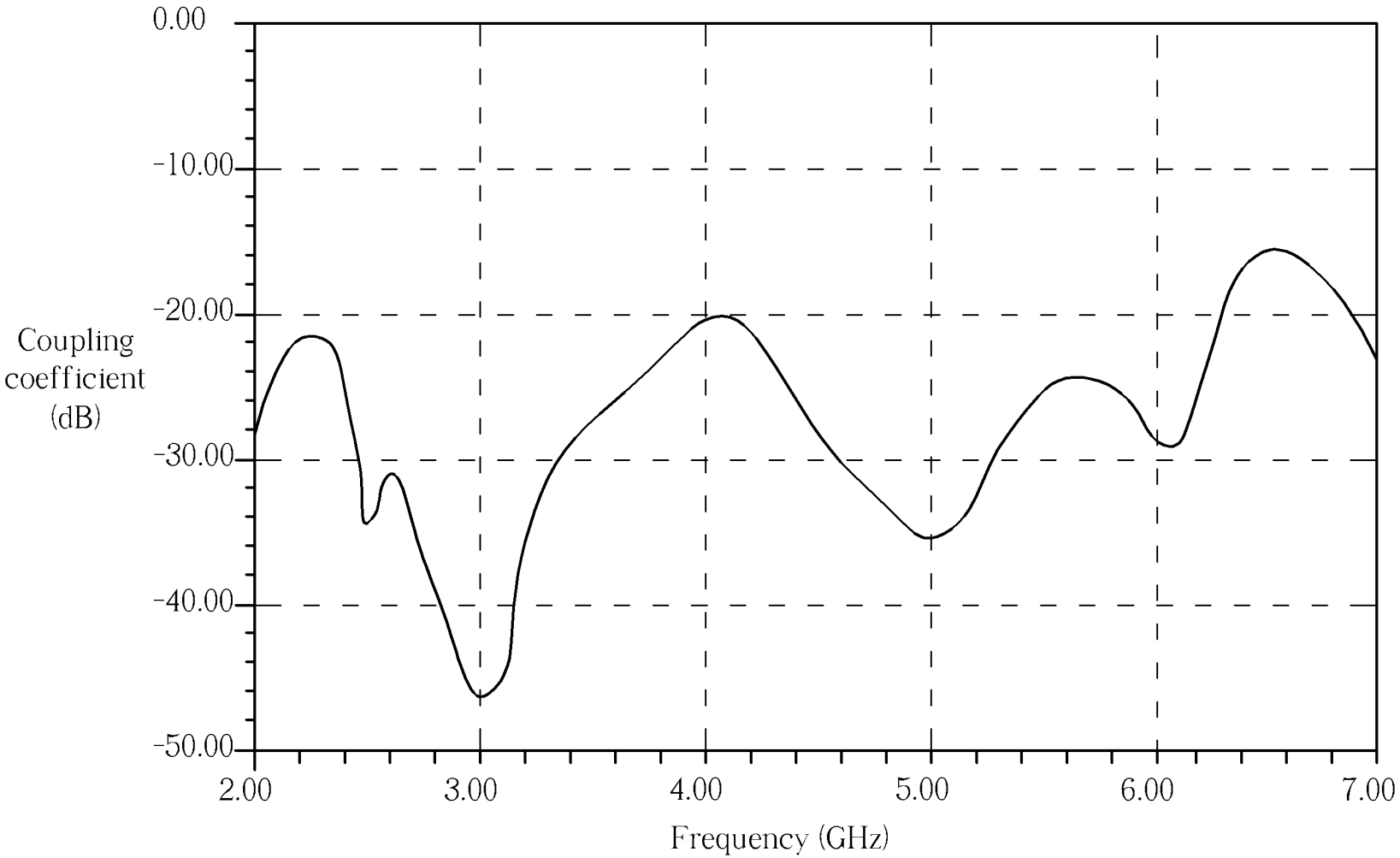
FIG. 15 illustrates a coupling coefficient of the circular polarization antenna shown in FIG. 13.
Figure 16A:
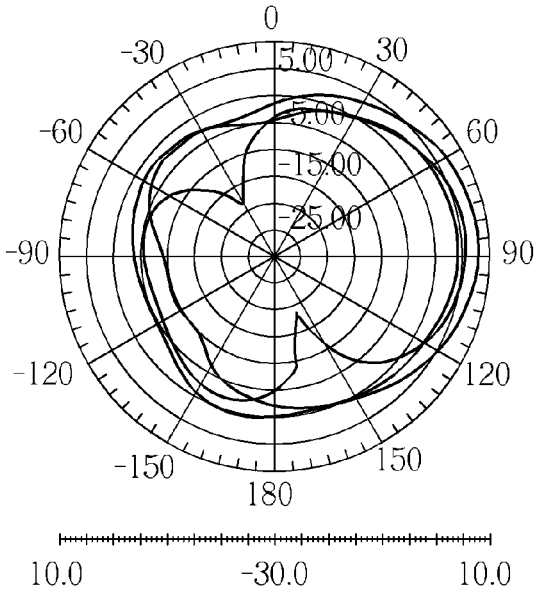
FIG. 16A to FIG. 16D are antenna gain diagrams of the circular polarization antenna shown in FIG. 13.
Figure 16B:
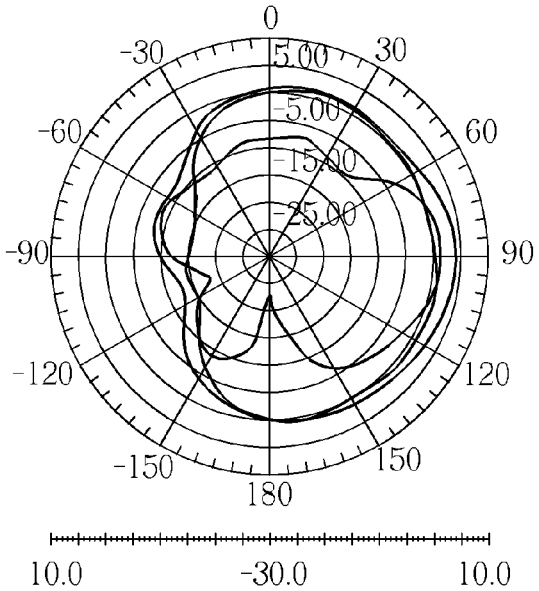
Figure 16C:
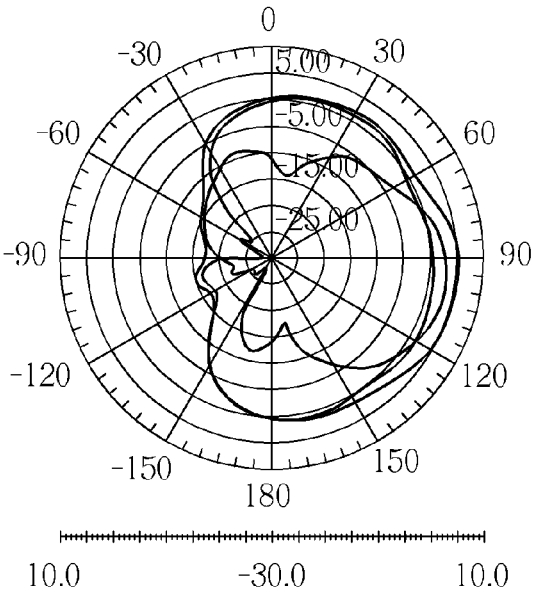
Figure 16D:
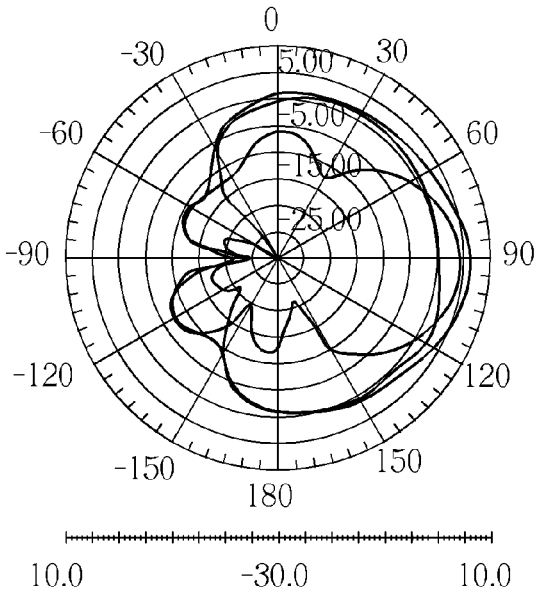
Figure 17A:
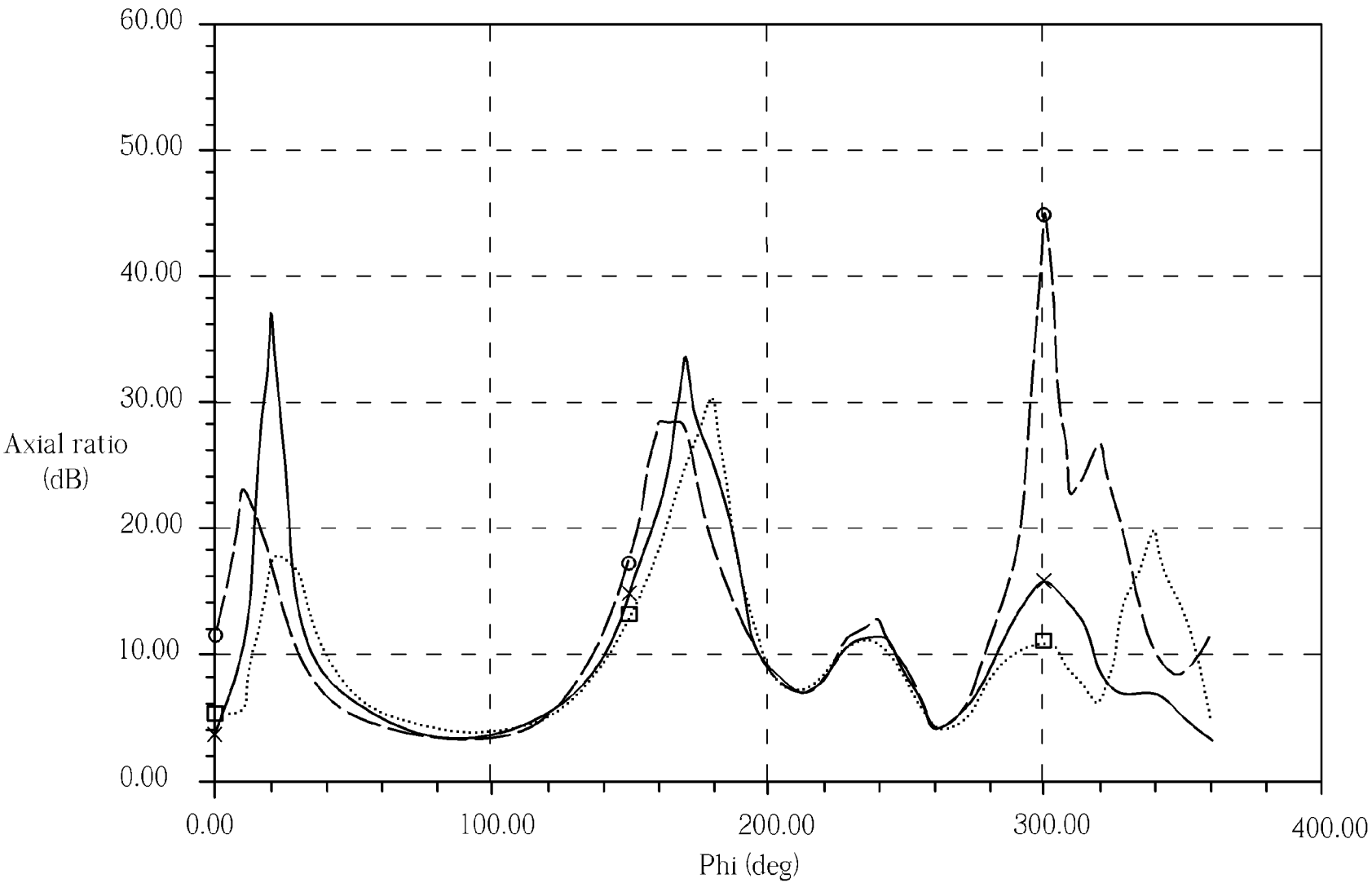
FIG. 17A-17B are axial ratio diagrams of the circular polarization antenna shown in FIG. 13.
Figure 17B:
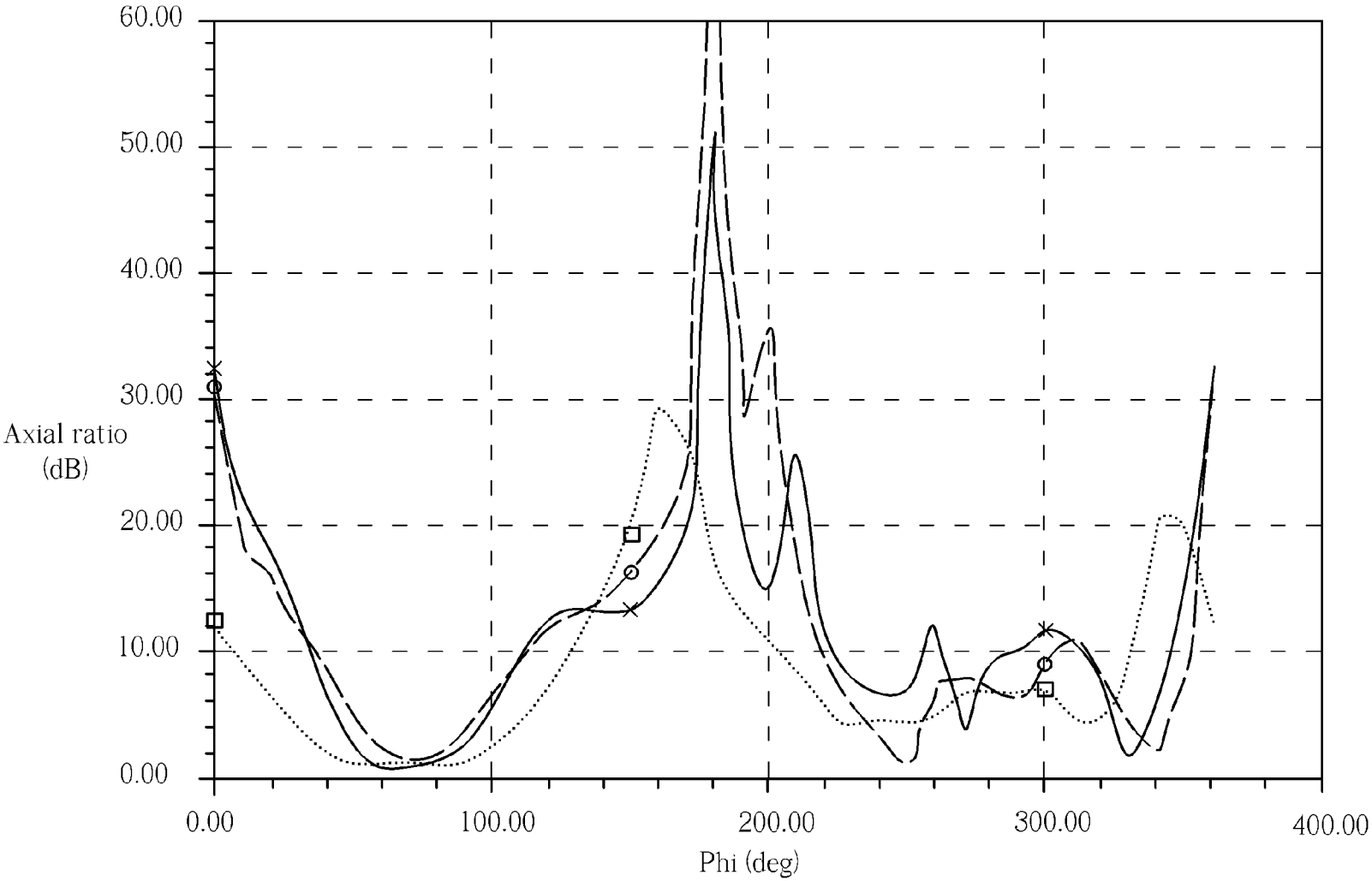

Please refer to FIG. 13, which is a schematic diagram of a circular polarization antenna 20 according to an embodiment of the present invention. The circular polarization antenna 130 includes a horizontal substrate 131, a vertical substrate 132, a horizontal polarization antenna 133 and a vertical polarization antenna 134. The horizontal substrate 131 and the vertical substrate 132 are realized by an FR4 double-layer fiberglass board, respectively, and are orthogonally assembled with each other. The horizontal polarization antenna 133 and the vertical polarization antenna 134 are formed in metal layers of the horizontal substrate 131 and the vertical substrate 132, respectively, and are utilized for generating a horizontal polarization field and a vertical polarization field. In the embodiment of the present invention, the horizontal polarization antenna 133 and the vertical polarization antenna 134 are each realized by a printed dual-band Yagi-Uda antenna, and include feeding terminals FED1 and FED2, drivers DRV1 and DRV2, directors DIR1 and DIR2, and reflectors REF1 and REF2.

The feeding terminals FED1 and FED2 are utilized for receiving identical feeding signals with a specific phase difference. The drivers DRV1 and DRV2 each include two dipole antennas of different operating frequencies, and are utilized for providing radiation patterns of two frequency bands. The directors DIR1 and DIR2 are utilized for directing the radiation patterns generated by the drivers DRV1 and DRV2 toward a +Y-axis direction. The reflectors REF1 and REF2 are coupled to a system ground, and are utilized for reflecting the radiation patterns generated by the drivers DRV1 and DRV2 toward the +Y-axis direction. As a result, the printed dual-band Yagi-Uda antenna can provides high directive radiation patterns in a same plane. For detailed descriptions of the printed dual-band Yagi-Uda antenna, please refer to ROC Patent Application NO. 098135250 "Printed Dual-Band Yagi-Uda Antenna".

In the embodiment of the present invention, the circular polarization antenna 130 further includes an assembly mechanism 25, for orthogonally assembling the horizontal substrate 131 and the vertical substrate 132 with each other. For example, the assembly mechanism 135 can be realized by a slot on the horizontal substrate 131 and an insertion element formed of the vertical substrate 132, and is not limited to this. Besides, length of the vertical substrate 132 can be extended, e.g. 5 mm, for preventing short-circuit between fire wires and ground wires of the two antennas.

In such a condition, when the size of radiation elements of the circular polarization antenna 130 is properly adjusted to make the circular polarization antenna 130 able to be applied in a dual-band (2.4 GHz and 5.12 GHz) wireless local area network (WLAN) system conforming to IEEE 802.11 standard, the dimensions of the horizontal polarization antenna 133 is substantially 50 mm×50 mm×1.6 mm, the dimensions of the vertical polarization antenna 134 is substantially 50 mm×55 mm×1.6 mm, and the dimensions of the assembly mechanism 135 is substantially 15 mm×10 mm×1.6 mm. Antenna characteristic simulation results of the circular polarization antenna 130 are shown in FIG. 3 to FIG. 6. FIG. 3 is a reflection coefficient diagram of the circular polarization antenna 130, FIG. 4 is a coupling coefficient diagram of the circular polarization antenna 130, FIG. 5A to FIG. 5D are antenna gain diagrams of the circular polarization antenna 130, and FIG. 6A and FIG. 6B are axial ratio diagrams of the circular polarization antenna 130.

As shown in FIG. 3, when a criterion is set at −10 dB, a low frequency band of the circular polarization antenna 20 is substantially between 2.39 GHZ~2.51 GHz, while a high frequency band of the circular polarization antenna 130 is substantially between 4.79 GHz~6.46 GHz. The reflection coefficient lower than −10 dB at the high frequency band and the low frequency band means most of energy can be fed into the antenna, and thus the circular polarization antenna 130 has excellent radiation efficiency at these operating frequencies.

FIG. 4 illustrates a coupling coefficient between the horizontal polarization antenna 133 and the vertical polarization antenna 134. The coupling coefficient is obtained by measuring or simulating a ratio of energy transmitting from the horizontal polarization antenna 133 to the vertical polarization antenna 134 (through electromagnetic coupling) when setting the vertical polarization antenna 134 as an output terminal and the horizontal polarization antenna 133 as an input terminal. Since the polarization directions of the two antennas are orthogonal, the coupling coefficients at the operating frequency band are all below −20 dB. Thus, the horizontal polarization antenna 133 and the vertical polarization antenna 134 have excellent isolation.

As shown in FIG. 5A to FIG. 5D, the radiation patterns of the circular polarization antenna 130 have excellent directivity both in the high frequency band and the low frequency band. Besides, compared to the printed dual-band Yagi-Uda antenna realized in a single plane, the circular polarization antenna 130 has higher directivity and antenna gain.

Finally, FIG. 6A and FIG. 6B illustrates axial ratios of the circular polarization antenna 130 in the high frequency band and the low frequency band, respectively. In FIG. 6A, dotted line represents 2.4 GHZ, solid line represents 2.45 GHz, and dashed line represents 2.5 GHZ. In FIG. 6B, dotted line represents 5 GHZ, solid line represents 5.5 GHz, and dashed line represents 5.8 GHZ. As shown in FIG. 6A and FIG. 6B, the circular polarization antenna 130 has a sufficiently low axial ratio in direction with antenna directivity, and can provide an excellent radiation pattern of circular polarization.

To sum up, the present invention provides the printed dual-band Yagi-Uda antenna, which needs not any extra mechanisms or devices to modify the radiation pattern and has the high directivity in both the high frequency band and the low frequency band. In addition, the present invention further orthogonally assembles two identical linear polarization antennas to realize the circular polarization antenna for the MIMO system. Besides, the radiation fields of all kinds of polarization directions, such as the left-hand circular polarization, the right-hand circular polarization or the elliptical polarization, can be generated by the circular polarization antenna according to different signal feeding manners, such that polarization matching and transmission efficiency of the MIMO system can be enhanced.

Those skilled in the art will readily observe that numerous modifications and alterations of the device and method may be made while retaining the teachings of the invention.

What is claimed is:

1. A printed dual-band Yagi-Uda antenna, comprising:

a substrate;

a first driver, formed on the substrate, for generating a radiation pattern of a first frequency band;

a first director, formed at a side of the first driver on the substrate in a first direction, for directing the radiation pattern of the first frequency band toward the first direction;

a second driver, formed between the first driver and the first director on the substrate, for generating a radiation pattern of a second frequency band, wherein a distance between the second driver and the first director makes the first director an open-circuit element of the second frequency band;

a reflector, formed at another side of the first driver on the substrate in an opposite direction of the first direction, for reflecting both the radiation patterns of the first frequency band and the second frequency band toward the first direction;

a transmission line, formed along the first direction on the substrate, sequentially coupled to the reflector, the first driver and the second driver;

a matching element, formed adjacent to the second driver on the substrate, for increasing a bandwidth of the second frequency band as a reactive load;

wherein, the substrate includes a first metal layer and a second metal layer, the matching element is formed in the first metal layer, and the reflector is formed in the second metal layer.

2. The printed dual-band Yagi-Uda antenna of claim 1, wherein the first driver is a dipole antenna perpendicular to the first direction, and the dipole antenna comprises a first radiation element and a second radiation element, formed in the first metal layer and the second metal layer, respectively.

3. The printed dual-band Yagi-Uda antenna of claim 1, wherein the second driver is a dipole antenna perpendicular to the first direction, and the dipole antenna comprises a first radiation element and a second radiation element, formed in the first metal layer and the second metal layer, respectively.

4. The printed dual-band Yagi-Uda antenna of claim 1, wherein the first director is formed in the first metal layer.

5. The printed dual-band Yagi-Uda antenna of claim 1, wherein the transmission line is a microstrip line.

6. The printed dual-band Yagi-Uda antenna of claim 1 further comprising a feeding terminal, formed at an end of the transmission line coupled to the reflector.

7. The printed dual-band Yagi-Uda antenna of claim 1, wherein the reflector is coupled to a ground of the printed dual-band Yagi-Uda antenna.

8. The printed dual-band Yagi-Uda antenna of claim 1, wherein a distance between the first driver and the first director is substantially 0.1 to 0.25 times a wavelength of the first frequency band.

9. The printed dual-band Yagi-Uda antenna of claim 1, wherein a distance of the first driver and the reflector is substantially 0.1 to 0.25 times a wavelength of the first frequency band.

10. The printed dual-band Yagi-Uda antenna of claim 1, wherein lengths of the first driver and the second driver are half wavelengths of the first frequency band and the second frequency band, respectively.

11. The printed dual-band Yagi-Uda antenna of claim 1, wherein the substrate is an FR4 double-layer fiberglass board.

12. The printed dual-band Yagi-Uda antenna of claim 1, wherein the first frequency band and the second frequency band are corresponding to operating frequencies of IEEE 802.11b/g and IEEE 802.11a, respectively.

13. A circular polarization antenna, comprising:

a first substrate;

a second substrate perpendicular to the first substrate;

a first linear polarization antenna, formed on the first substrate, for generating a radiation field of a first polarization direction according to a first feeding signal; and a second linear polarization antenna, formed on the second substrate and having a same structure as the first linear polarization antenna, for generating a radiation field of a second polarization direction according to a second feeding signal;

wherein the first linear polarization antenna and the second linear polarization antenna are a printed dual-band Yagi-Uda antenna as claimed in claim 1, the first polarization direction is orthogonal to the second polarization direction, and the first feeding signal and the second feeding signal are a same feeding signal with a specific phase difference.

14. The circular polarization antenna of claim 13, wherein the first feeding signal has a 90 degree phase lead over the second feeding signal.

15. The circular polarization antenna of claim 13, wherein the first feeding signal has a 90 degree phase lag behind the second feeding signal.

16. The circular polarization antenna of claim 13, wherein the first substrate comprises a slot, and the second substrate comprises an insertion element, the slot and the insertion element forming an assembly mechanism of the first substrate and the second substrate.

17. The circular polarization antenna of claim 13, wherein the first linear polarization antenna comprises a feeding terminal, a driver, a director and a reflector, the feeding terminal being utilized for receiving the first feeding signal, the reflector being coupled to a system ground.

18. The circular polarization antenna of claim 13, wherein the second linear polarization antenna comprises a feeding terminal, a driver, a director and a reflector, the feeding terminal being utilized for receiving the second feeding signal, the reflector being coupled to a system ground.

19. The circular polarization antenna of claim 13, wherein the first linear polarization antenna and the second linear polarization antenna have a radiation pattern directing toward a third direction, the third direction being orthogonal to the first polarization direction and the second polarization direction.

20. The circular polarization antenna of claim 13, wherein the first substrate and the second substrate are an FR4 double-layer fiberglass board, respectively.

21. The circular polarization antenna of claim 13, wherein the first polarization direction is parallel to the first substrate and the second polarization direction is parallel to the second substrate.

* * * * *